United States Patent [19]

Lin et al.

[11] 4,209,425

[45] * Jun. 24, 1980

[54] CONDUCTIVE COATING COMPOSITION

[75] Inventors: Kingso C. Lin; Donald J. Hammond, both of Newark, Ohio

[73] Assignee: Owens-Corning Fiberglas Corporation, Toledo, Ohio

[ * ] Notice: The portion of the term of this patent subsequent to May 23, 1995, has been disclaimed.

[21] Appl. No.: 789,914

[22] Filed: Apr. 22, 1977

[51] Int. Cl.[2] ..... H01B 1/06

[52] U.S. Cl. ..... 252/510; 252/511; 174/102 SC; 174/105 SC; 174/120 SC

[58] Field of Search ..... 252/510, 511; 174/102 SC, 105 SC, 120 SC; 260/29.6 R

[56] References Cited

U.S. PATENT DOCUMENTS

| | | | |
|---|---|---|---|
| 2,282,832 | 5/1942 | Spooner | 252/511 |
| 2,409,893 | 10/1946 | Pendleton et al. | 252/510 X |
| 4,001,159 | 1/1977 | Imai et al. | 260/29.6 R X |
| 4,065,417 | 12/1977 | Wong et al. | 260/830 R X |
| 4,090,984 | 5/1978 | Lin et al. | 252/511 |

*Primary Examiner*—E. Suzanne Parr

*Attorney, Agent, or Firm*—Ronald C. Hudgens; Philip R. Cloutier; James B. Wilkes

[57] ABSTRACT

A conductive coating is disclosed, the coating comprising conductive particles, at least one surfactant, a thixotropic gelling agent, and, optionally, an organosilane coupling agent and a defoamer. The coating is suitable for use as a slip coating, which coating is particularly suitable for use in the production of conductive cores employed to produce electrical cables.

12 Claims, 1 Drawing Figure

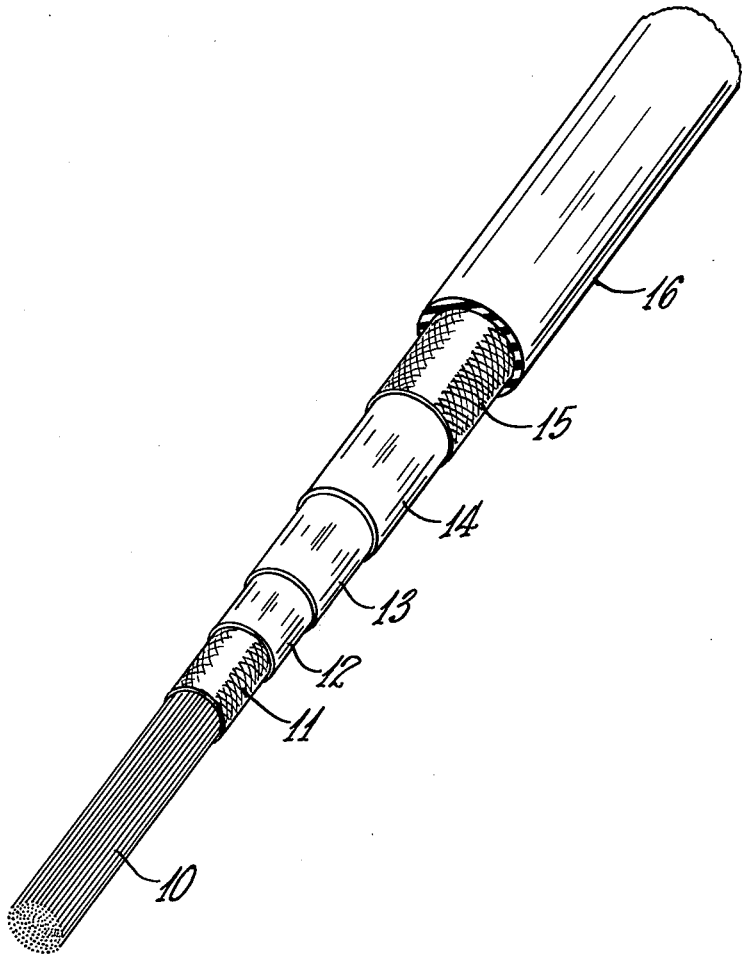
16
15
14
13
12
11
10

CONDUCTIVE COATING COMPOSITION

This invention relates to conductive cores for electrical cables.

More specifically, this invention relates to glass fiber-containing conductive cores for electrical cables.

In one of its more specific aspects, this invention relates to a conductive slip coating superimposed on coated glass fiber roving, which roving is employed to produce conductive cores for electrical cables.

The use of glass fiber roving in the production of conductive cores for electrical cables, such as automobile ignition cables, is well known. For example, see U.S. Pat. No. 3,991,397. Also known in the art is the employment of a conductive slip coating. Generally, in the production of conductive cores, the conductive slip coating is applied prior to the application of the primary insulation coatings in order to facilitate removal of the primary insulation coatings and, accordingly, facilitates electrical terminal connection.

This invention provides a conductive slip coating which is particularly suitable for the above described application.

According to this invention, there is provided an aqueous conductive slip coating composition comprising conductive particles, at least one surfactant, a thixotropic gelling agent, and, optionally, an organosilane coupling agent and, or, a defoamer.

Also according to this invention, there is provided a conductive slip coating comprising the residue produced by removing water from an aqueous composition comprising conductive particles, at least one surfactant, a thixotropic gelling agent, and, optionally, an organosilane coupling agent and, or, a defoamer.

According to this invention there is also provided an electrical cable comprising a coating comprising the residue produced by removing water from an aqueous composition comprising conductive particles, at least one surfactant, a thixotropic gelling agent, and, optionally, an organosilane coupling agent and, or, a defoamer.

In the practice of this invention, any suitable conductive particles can be employed.

Preferred conductive particles are graphite or carbon particles having an average particle size of less than 1 micron.

A particularly suitable conductive particle for use in the coating is "Graphite Micro #250", a graphite powder, commercially available from Asbury Graphite Mills, Inc. "Graphite Micro #250" has an average particle size of from about 0.5 to about 0.6 micron.

In the practice of this invention, the conductive particles will be employed in an amount within the range of from about 5 to about 15 percent by weight of the aqueous composition.

Any suitable surfactant or mixture thereof can be employed in the aqueous composition.

Particularly suitable surfactants are designated by the trademarks "Igepal", commercially available from GAF Corporation and "Triton", commercially available from Rohm & Haas Company.

"Igepal" is the trademark for a series of alkylphenoxypoly(oxyethylene)ethanols, resulting from the combination of an alkylphenol with ethylene oxide. Particularly suitable for use is the "Igepal CO" series of nonylphenoxypoly(ethyleneoxy)ethanols.

"Triton" is the trademark for a series of surfactants based on alkylaryl polyether alcohols, sulfonates and sulfates. Particularly suitable for use is "Triton X-100" an octylphenoxy polyethoxy ethanol.

In the practice of this invention, the surfactant will be employed in a total amount within the range of from about 3 to about 5 percent by weight of the aqueous composition.

Any suitable thixotropic gelling agent can be employed in the aqueous composition. Suitable thixotropic gelling agents include acid-containing acrylic emulsion copolymers and cellulose ethers.

A particularly suitable acid-containing acrylic emulsion copolymer is designated "Acrysol ASE 108", commercially available from Rohm & Haas Company. "Acrysol ASE 108" has a solids content of 20%, a pH of 2.9, a Brookfield viscosity, Model No. LVF (#1 spindle, 12 rpm) at 25° C. of 200 cps. and is anionic.

Other suitable acid-containing acrylic emulsion copolymers are designated "Acrysol ASE 60", "Acrysol ASE 75" and "Acrysol ASE 95", all commercially available from Rohm & Haas Company.

Particularly suitable cellulose ethers are methylcellulose, ethylcellulose, hydroxypropyl methylcellulose, mixtures thereof, and the like. Cellulose ethers employable in the aqueous composition are commercially available from The Dow Chemical Company, under the tradename "Methocel".

In the practice of this invention, the thixotropic gelling agent will be employed in an amount within the range of from about 3 to about 10 percent by weight of the aqueous composition.

Optionally, an organosilane coupling agent can be employed in the aqueous coating composition.

A particularly suitable organosilane coupling agent is designated "A-163", commercially available from Union Carbide. "A-163" is methyltrimethoxysilane.

If employed, the organosilane coupling agent will be present in an amount up to about 5 percent by weight of the aqueous composition.

Optionally, any suitable defoamer can be employed in the aqueous composition.

Particularly suitable defoamers comprise blends of emulsifiable mineral oils, silica derivatives and esters.

Various defoamers, usable in the practice of this invention are commercially available, for example, "Drew Defoamers" available from the Drew Chemical Company. Reference is hereby made to U.S. Pat. No. 3,408,306 which discloses a defoamer comprising a blend of emulsifiable mineral oils, silica derivatives and esters, which defoamer has been assigned the tradename "Drew Y-250 Defoamer" and is particularly suitable for use in this invention.

Also suitable is a defoamer designated "Antifoam H-10", commercially available from Dow Corning. "Antifoam H-10" is a polyorganosiloxane.

If employed, the defoamer will be present in an amount up to about 0.1 percent by weight of the aqueous composition.

Water will comprise the balance of the composition.

Included in this specification is a drawing.

The drawing is a perspective view, with cut away portions, showing one embodiment of the conductive slip coating of this invention employed in automobile ignition cable.

In the drawing, there is shown an automobile ignition cable comprised of glass fiber roving 10 having a overbraid 11, a semi-conductive coating 12, a conductive slip coating 13, a primary insulation coating 14, a strength braid 15, and an outer jacket coating 16.

The conductive slip coating 13 is a conductive slip coating according to the practice of this invention.

The aqueous composition is prepared by conventional methods such as that described below. The composition can be superimposed on any glass fiber roving, the number of strands depending upon the particular end application of the resulting conductive core. A suitable roving for automobile ignition cable will comprise about 60 strands of about 204 fibers, each.

Preferably, the composition is superimposed on coated glass fiber roving, which roving is first topcoated with an overbraid and a semi-conductive coating using any suitable process, for example, a dipping process, such that upon drying, the residue of the aqueous slip coating composition comprises from about 0.5 to about 3 percent by weight of the total weight of the coated glass fiber roving 10, the overbraid 11, the semi-conductive coating 12, and the conductive slip coating 13, as determined by loss on ignition.

Having described the ingredients usable in this invention, reference is now made to the following example which is provided by way of illustration and not by way of limitation of the practice of this invention.

EXAMPLE I

The following example demonstrates the best mode for the preparation of 100 gallons of a conductive slip coating composition according to this invention.

About 143 pounds of water at a temperature of about 140° to about 150° F. and about 45 pounds of a surfactant, "Triton X-100", were introduced into a main mix tank at room temperature with agitation.

About 415 pounds of water at a temperature of about 60° to about 80° F. were introduced to the main mix tank with agitation.

About 3 pounds of "A-163" and 0.2 pound of a defoamer, "Antifoam H-10", were introduced into the main mix tank and the contents of the main mix tank were agitated for about 5 minutes.

About 114 pounds of conductive particles, "Graphite Micro #250", were introduced into the main mix tank and the contents of the main mix tank were agitated for about 15 minutes.

The contents of the main mix tank were homogenized at a pressure of about 4000 psi.

About 51 pounds of a thixotropic gelling agent, "Acrysol ASE 108", were mixed into the main mix tank at room temperature with agitation.

The contents of the main mix tank were agitated for about 30 minutes and recovered as an aqueous conductive slip coating composition of this invention. The composition was found to have a pH of 4.1, a viscosity of about 100 to about 200 cps. as measured on a Brookfield viscometer, Model No. LVF (#1 spindle, 20 rpm), and a solids content of about 20 to 21 percent.

The aqueous conductive slip coating was applied, using a dipping process, to a conductive core, which core was produced using substantially the same procedure described in U.S. Pat. No. 3,991,397.

The conductive slip coating was tested and found to have a resistance of about 3500 ohms/yd.

Next, a primary insulation coating, a strength braid and an outer jacket coating were separately superimposed over the conductive slip coating to produce automobile ignition cable.

The resulting cable was stripped for electrical terminal connection, that is, the primary insulation coating and coatings superimposed overtop thereof were removed. Visual observation of the stripped cable indicated no surface damage to the conductive core.

It is evident from the foregoing that various modifications can be made to this invention. Such, however, are considered as being within the scope of this invention.

What is claimed is:

1. An aqueous composition comprising about 5 to about 15 percent by weight of conductive particles, about 3 to about 5 percent by weight of surfactant and about 3 to about 10 percent by weight of a thixotropic gelling agent selected from the group consisting of acid-containing acrylic emulsion copolymers and cellulose ethers.

2. The composition of claim 1 which also includes up to about 5 percent by weight of an organosilane coupling agent and up to about 0.1 percent by weight of a defoamer.

3. The composition of claim 1 in which said conductive particles are graphite or carbon particles having an average particle size of less than 1 micron.

4. The composition of claim 2 comprising, in percent by weight of said composition, said organosilane coupling agent in an amount up to about 5 and said defoamer in an amount up to about 0.1.

5. A conductive slip coating comprising the residue produced by removing water from the aqueous composition defined in claim 1.

6. The composition of claim 1 wherein said thixotropic gelling agent is an acid-containing acrylic emulsion copolymer.

7. A composition consisting essentially of about 5 to about 15 percent by weight of conductive particles, about 3 to about 5 percent by weight of surfactant, about 3 to about 10 percent by weight of thixotropic gelling agent selected from the group consisting of acid-containing acrylic emulsion copolymers and cellulose ethers and water.

8. The composition of claim 7 wherein said conductive particles are graphite or carbon particles having an average size of less than 1 micron.

9. The composition of claim 8 wherein said thixotropic gelling agent is an acid-containing acrylic emulsion copolymer.

10. A composition consisting essentially of about 5 to about 15 percent by weight of conductive particles, about 3 to about 5 percent surfactant, about 3 to about 10 percent by weight of thixotropic gelling agent selected from the group consisting of acid-containing acrylic emulsion copolymers and cellulose ethers, up to about 5 percent by weight of organosilane coupling agent, up to about 0.1 percent by weight of defoamer and water.

11. The composition of claim 10 wherein said conductive particles are graphite or carbon particles having an average size of less than 1 micron.

12. The composition of claim 11 wherein said thixotropic gelling agent is an acid-containing acrylic emulsion copolymer.

* * * * *